United States Patent [19]

Yamamoto

[11] Patent Number: 4,467,717

[45] Date of Patent: Aug. 28, 1984

[54] SCREW PRESS DEHYDRATOR PROVIDED WITH CAKE CUTTER

[75] Inventor: Toshiyoshi Yamamoto, Nobeoka, Japan

[73] Assignee: Sanshukakan Kogyo Kabushiki Kaisha, Nobeoka, Japan

[21] Appl. No.: 436,358

[22] Filed: Oct. 25, 1982

[30] Foreign Application Priority Data

Oct. 30, 1981 [JP] Japan ..... 56-174801

[51] Int. Cl.[3] ..... B30B 9/12

[52] U.S. Cl. ..... 100/117

[58] Field of Search ..... 100/117, 145–150

[56] References Cited

FOREIGN PATENT DOCUMENTS 34635 8/1972 Japan .
5819 3/1975 Japan .
156 1/1980 Japan .

*Primary Examiner*—Peter Feldman

*Attorney, Agent, or Firm*—Stevens, Davis, Miller & Mosher

[57] ABSTRACT

A screw press dehydrator provided with a cake cutter which is formed of a plurality of stationary plates and sliding plates each containing circular holes and disposed alternately around a screw barrel at a position closer to the discharge outlet side thereof, with a screw laid through the circular holes. A smaller circular hole is provided in each of the sliding plates. A revolutionary motion is imparted to the sliding plates such that the centers of the circular holes in the sliding plates may describe a circle of a fixed radius about the centers of the circular holes in the stationary plates and the circumferences of the circular holes in the revolving sliding plates may remain in contact with the circular holes in the stationary plates. The screw press dehydrator of this invention causes the wet cake to be alternately expelled expansively and repelled contractively within the larger circular holes of the sliding plates in a direction which gradually shifts throughout the entire periphery of the screw barrel.

5 Claims, 4 Drawing Figures

SCREW PRESS DEHYDRATOR PROVIDED WITH CAKE CUTTER

BACKGROUND OF THE INVENTION

This invention relates to a screw press dehydrator to be used for removal of water from sewage sludge or various industrial waste sludges or for solid-liquid separation of sludgy materials during the course of manufacture of various products. More particularly, this invention relates to a screw press dehydrator provided with a cake cutter which is capable of causing the wet cake, which is being dehydrated by the pressure applied thereto with a screw within a screw barrel in the axial direction thereof, to be alternately expelled expansively toward the periphery of the screw barrel and repelled contractively inwardly repeatedly in concert with the aforementioned pressing in the axial direction thereby effecting required dehydration of the wet cake with efficiency improved over the heretofore attainable level.

A screw press dehydrator provided with a cake cutter has heretofore been proposed in Japanese Patent Publication No. 156/1980, wherein a multiplicity of stationary plates and sliding plates are alternately disposed round a screw barrel at a position closer toward the discharge outlet side thereof. The stationary plates each contain a circular hole and the sliding plates each containing an oblong hole terminating in semicircles of a radius equal to the radius of the aforementioned circular hole in the stationary plates. A screw is laid through the alternating circular and oblong holes respectively of the stationary and sliding plates, so that the sliding plates may be reciprocated, as simultaneously slid against the adjacent stationary plates, in the direction of the major axes of their oblong holes between the positions at which the opposite semicircles at the ends of the oblong holes in the sliding plates coincide with the corresponding halves of the circles of the circular holes in the stationary plates.

The aforementioned screw press dehydrator is provided with a cake cutter, wherein the rotation of the screw causes the wet cake to be pressed inside the screw barrel in the axial direction thereof and the reciprocating sliding motion of the sliding plates causes the wet cake inside the oblong holes therein to be alternately expelled expansively toward the periphery of the screw barrel and repelled contractively inwardly repeatedly. As a result, the removal of water from the wet cake is effected more efficiently than when the wet cake is dehydrated solely by virtue of the pressure applied by the screw. The water lodged in the deep portion of the wet cake migrates sparingly to the surface portion and, therefore, is not readily separated from the sludge. When the wet cake is repeatedly expelled expansively and repelled contractively alternately as described above, the oscillation thus imparted to the wet cake accelerates the migration of the water lodged in the deep portion of the wet cake to a point where the removal of water from the wet cake will be effected with enhanced efficiency.

In the aforementioned screw press dehydrator provided with the cake cutter, the expansive expulsion and the contractive repulsion of the wet cake alternately carried out vertically or horizontally in an intermittent manner by the reciprocating sliding motion of the sliding plates, causes a disadvantage in that the wet cake is violently pulsated and the spaces intervening between the stationary plates and the slding plates, which are primarily intended for escape of the water component of the wet cake, suffer from heavy leakage of the solid component of the wet cake. Moreover, the impacts of the violent pulsation of the wet cake detracts from the service life of the dehydrator. Further, since the alternating expansive expulsion and contractive repulsion of the wet cake occur only in one vertical or horizontal direction, uniform migration of the water component from the deep portion of the wet cake to the entire surface of the mass of wet cake cannot be obtained and, therefore, the efficiency of the dehydrator can be improved.

Another screw press dehydrator has been proposed, in Japanese Patent Publication No. 5819/1975, wherein a multiplicity of stationary plates and sliding plates are alternately disposed around a screw barrel at a position close to the discharge outlet side thereof. The stationary plates and the sliding plates each contain a circular hole of a fixed diameter, a screw laid through the circular holes of the alternating stationary and wherein sliding plates, and the sliding plates are oscillated around the centers of their circular holes which are kept in coincidence with the circular holes of the stationary plates.

In the screw press dehydrator just described, the sliding plates are oscillated solely for the purpose of preventing the spaces between the stationary plates and the sliding plates, i.e. the openings intended for escape of the water component of the wet cake, from being clogged with solid particles, the sliding plates are not intended to alternately expel the wet cake expansively and repel it contractively. Thus, this screw press dehydrator is inferior in terms of efficiency of water removal to the screw press dehydrator which is provided with the aforementioned cake cutter.

SUMMARY OF THE INVENTION

An object of this invention is to provide a screw press dehydrator provided with a cake cutter which is capable of enabling the alternating expansive expulsion and contractive repulsion of the wet cake to be continuously and uniformly carried out relative to the entire periphery of the screw barrel. This object of the present invention is accomplished by alternately disposing a multiplicity of stationary plates and sliding plates, giving a smaller circular hole to each of the stationary plates and a larger circular hole to each of the sliding plates, and imparting to the sliding plates a revolving motion such that the centers of the circular holes in the sliding plates may describe a circle of a fixed diameter about the centers of the circular holes in the stationary plates and the circumferences of the circular holes in the revolving sliding plates may remain in contact with those of the circular holes in the stationary holes. This arrangement enables the direction in which the wet cake is alternately expelled expansively and repelled contactively within the larger circular holes of the sliding plates to be gradually shifted throughout the entire circumference of the screw barrel.

The other characteristics and advantages of the present invention will become apparent from the further disclosure of the invention to be made herein below with reference to the accompanying drawing. The apparatus illustrated in the accompanying drawing represents one preferred embodiment of this invention. This invention is not limited to the illustrated apparatus in any sense.

DETAILED DESCRIPTION OF THE INVENTION

Figure 1:
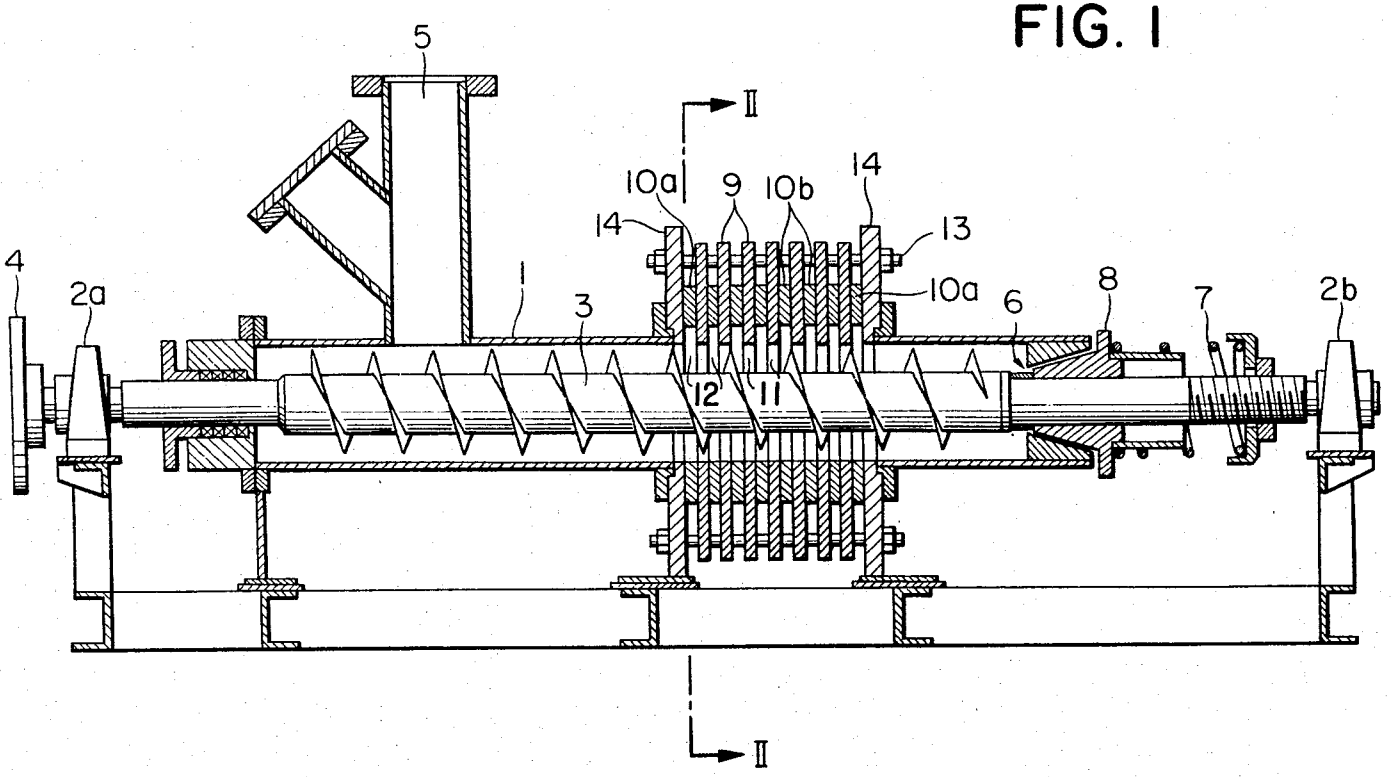
FIG. 1 is a longitudinal section illustrating a typical screw press dehydrator provided with a cake cutter according to the present invention.

As illustrated in FIG. 1, a screw 3, supported at the opposite ends thereof by bearings 2*a*, 2*b* is laid through the interior of a screw barrel 1. This screw 3 is rotated by means of a driving gear 4.

Toward the lefthand end of the screw barrel 1 as viewed in the diagram, an inlet 5 is provided for feeding the substance subjected to treatment into the screw barrel 1. The righthand end of the screw barrel 1 has a discharge outlet 6 for discharging completely drained cake from the screw barrel 1. This discharge outlet 6 is closed with a sliding boss 8 which is kept pressed toward the screw barrel 1 side by means of a spring 7. The substance under treatment is drained by being squeezed by the propelling force arising from the rotation of the screw 3 and the pressing force generated by the spring 7 on the sliding boss 8 toward the screw barrel 1. After the completely drained cake resulting from the dehydration operation mentioned above has accumulated, the propelling force is sufficient to overcome the pressing force of the spring 7, and the cake is forced through the discharge outlet 6 by repelling the sliding boss 8 and gradually departs from the discharge outlet 6. In the meantime, the water squeezed out of the substance under treatment is discharged through the spaces between stationary plates 9 and sliding plates 10*a*, 10*b*.

The construction of the screw press dehydrator of the present invention described above is similar to that of the conventional screw press dehydrator. The screw press dehydrator provided with the cake cutter according to the present invention, however, is characterized by the novel operation by its water-discharge section, i.e. the section formed of a multiplicity of stationary plates 9 and sliding plates 10*a*, 10*b* alternately disposed at a position closer to the discharge outlet 6 side of the screw barrel 1. The water-discharge section will be described in further detail below.

The stationary plates 9 and the sliding plates 10*a*, 10*b* are provided respectively with invariably circular holes 11, 12 which are alternately disposed at a position closer to the discharge outlet 6 side of the screw barrel. The screw 3 is laid through these circular holes.

Figure 2:
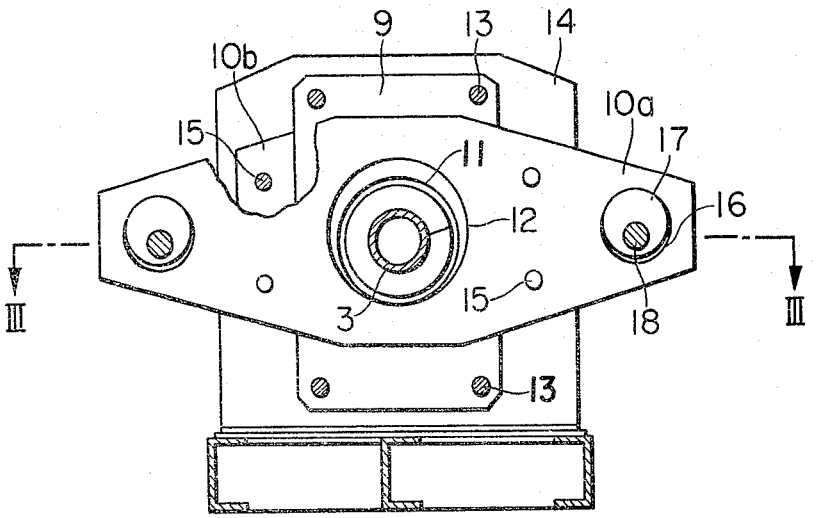
FIG. 2 is a cross section taken along the line II—II in the diagram of FIG. 1.
Figure 3:
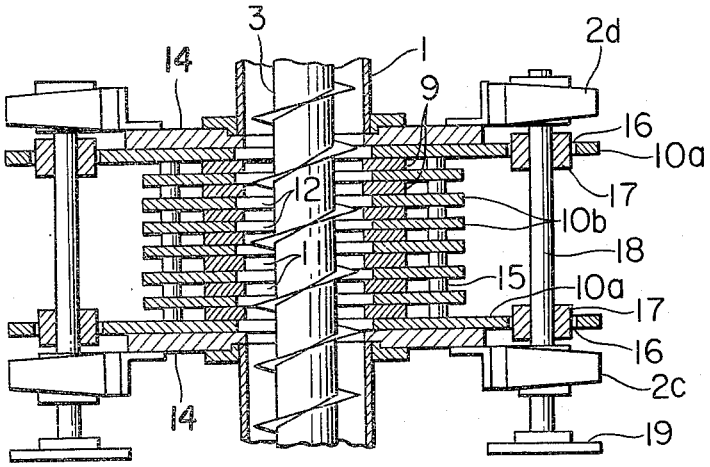
FIG. 3 is a longitudinal section taken along the line III—III in the diagram of FIG. 2.

The stationary plates 9 are fixed in position, as illustrated in FIG. 1 and FIG. 2, by means of supporting shafts 13 which are pierced through coinciding holes bored near the four corners of each of the stationary plates 9 and secured to two brackets 14 provided at opposite ends of the water-discharge section. The sliding plates 10*a*, 10*b*, as illustrated in FIG. 2 and FIG. 3, have their lateral sides protruding laterally from the corresponding sides of the stationary plates 9. They are collectively connected by four connecting shafts 15 which are pierced through the laterally protruding sides of the sliding plates 10*a*, 10*b*. The sliding plates 10*a* falling at the leading end and the trailing end of the water-discharge section have their lateral sides further protruding from the corresponding lateral sides of the intervening sliding plates 10*b*. In each of these further protruding lateral sides, a circular cam hole 16 is formed. In each of these cam holes 16, a circular cam 17 adapted to be freely rolled inside the cam hole 16, is loosely inserted. Rotary shafts 18, to which eccentrically fastened to each of the cams 17, are supported in position by bearings 2*c*, 2*d* which are secured in the aforementioned brackets 14. These rotary shafts 18 are rotated by means of operating gears 19. When the rotary shafts 18 are rotated and the cams 17 are rolled inside the cam holes 16, therefore, a revolutionary motion is imparted to the sliding plates 10*a*, 10*b* so that the centers of the circular holes 12 in the sliding plates 10*a*, 10*b* may describe a circle of a radius equalling the length corresponding to the amount of deviation between the cams 17 and the rotary shafts 18.

Figure 4:
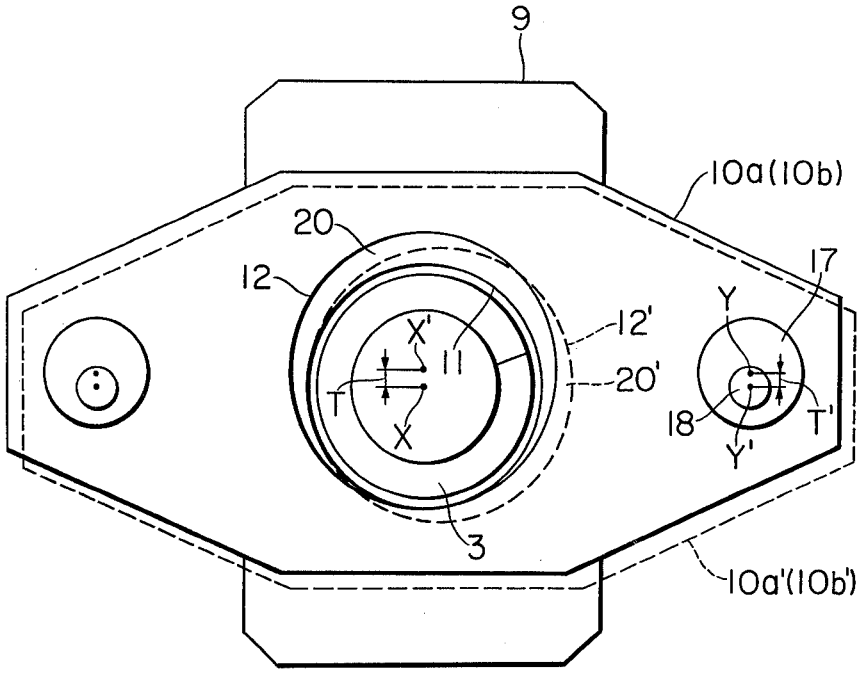
FIG. 4 is an explanatory diagram of the operation and effect of the present invention.

As described above, the stationary plates 9 and the sliding plates 10*a*, 10*b* respectively contain circular holes 11, 12. As illustrated in FIG. 2, the circular holes 12 in the sliding holes 10*a*, 10*b* have a larger radius than the circular holes 11 in the stationary holes 9. The centers of the circular holes 11 in the stationary holes 9 and those of the circular holes 12 in the sliding plates 10*a*, 10*b* are deviated relative to each other so that the circumferences of the circular holes 12 in the revolving sliding plates 10*a*, 10*b* may be kept in contact at one point at any given time with the circumferences of the circular holes 11 in the stationary plates 9. In other words, the aforementioned revolutionary motion imparted to the sliding plates 10*a*, 10*b* is such that the circular holes 11 and the circular holes 12 remain in contact at one point at all times. To be more specific, as illustrated in FIG. 4, the amount of deviation, T, between the centers X, X′ respectively of the circular holes 11, 12 equals the amount of deviation, T′, between the centers Y, Y′ respectively of the aforementioned cams 17 and the rotary shafts 18. Consequently, the revolutionary motion imparted to the sliding plates 10*a*, 10*b* will enable the sliding plates to rotate around their own centers and, at the same time, revolve around the centers of the stationary plates 9 so that the centers X′ of the circular holes 12 may describe a circle of a radius equalling the length corresponding to the amount of deviation, T, between the two circular holes 11, 12 (namely, the amount of deviation, T′, between the cams 17 and the rotary shafts 18).

Now, the operation and effect of the present invention will be described specifically below with reference to FIG. 4.

When the sliding plates 10*a* (10*b*) and their circular holes 12 are held at the positions indicated by the solid lines as illustrated, the lowermost points of the circular holes 12 coincide with the lowermost points of the circular holes 11 of the stationary plates 9 and the uppermost points of the circular holes 12 are higher than the uppermost points of the circular holes 11. Consequently, spaces 20 occur above the upper sides of the circular holes 11. The wet cake which has been expansively expelled by the pressure of the screw 3 enters into the spaces 20. When the sliding plates 10*a* (10*b*) and their circular holes 12 are moved to the positions 10*a*′ (10*b*′), 12′ indicated by the broken lines as illustrated in consequence of the revolutionary motion imparted as described above to the sliding plates 10*a* (10*b*), the spaces 20 will naturally be shifted to the position 20′, i.e.

to the right of the circular holes 11. In this case, the wet cake which has entered the spaces 20 is repelled inwardly in concert with the motion of the sliding plates 10*a* (10*b*). At the same time, the wet cake is newly forced into the spaces 20' by the pressure exerted by the screw 3. Consequently, the wet cake which is compressed by the screw 3 in the axial direction thereof is alternately expelled expansively toward the periphery of the screw barrel and repelled contractively inwardly. The oscillating motion thus imparted to the wet cake causes the water component lodged in the deep portion of the wet cake to migrate to the surface portion, with the result that the separation of the water component is promoted and the dehydrator efficiency is improved. Owing to the repetition of the alternating expansive expulsion and contractive repulsion, the wet cake keeps exposing its new surface within the dehydrator interior. The incessant change of the surface of the wet cake facilitates the separation of the water component from the wet cake and contributes to the promotion of the dehydration efficiency of the dehydrator.

The removal of water from the wet cake can be effected uniformly throughout the entire mass of the wet cake because the alternating expansive expulsion and contractive repulsion of the wet cake continuously occur relative to the entire circumference of the screw barrel. The wet cake is pulsated only sparingly. Thus, there is no possibility that the spaces between the stationary plates 9 and the sliding plates 10*a* (10*b*), which are primarily intended for removal of the water component, will allow the escape of an appreciable portion of the solid component or that the service life of the dehydrator will be shortened by the impacts of pulsation. The virtual absence of pulsation in the wet cake treated in the dehydrator of this invention is ascribable to the fact that the application of the load to the circumference of the wet cake is effected continuously at a fixed rate of speed, whereas in the conventional dehydrator, which effects the alternating expansive expulsion and contractive repulsion intermittently on the wet cake, the load is exerted intermittently upon the circumference of the wet cake which is being advanced by the propelling force of the screw 3.

The number of stationary plates and sliding plates for use in the dehydrator of this invention may be suitably fixed in due consideration of the size of the equipment and other similar factors. Generally, the total number of stationary plates and sliding plates is in the range of 10 to 30.

In the illustrated embodiment, only the two outermost sliding plates are depicted as being interlocked with rotary shafts. Optionally, all the sliding plates used may be interlocked with rotary shafts. Instead of having all the circular holes in the sliding plates assume one identical position at any given time relative to the circular holes in the stationary plates as in the illustrated embodiment, the circular holes in the sequential sliding plates may be circumferentially and incrementally deviated from one another relative to the circular holes in the stationary plates, so that the alternating expansive expulsion and contractive repulsion of the wet cake occur radially at circumferentially spaced points. This arrangement can be obtained by incrementally shifting the directions of deviation between the centers of the circular holes in the stationary plates and those of the circular holes in the sliding plates and the directions of deviation between the centers of the cams and those of the rotary shafts successively in the sequential sliding plates. In this arrangement, the promotion of the dewatering efficiency is further enhanced because the expansive expulsion and contractive repulsion of the wet cake occur simultaneously and radially.

The revolutionary motion to be imparted to the sliding plates is desired to occur synchronously with and in the same direction as the rotation of the screw. This is an important factor in the sense that the advance of the wet cake in the screw barrel by the propelling force of the screw should proceed without any obstacle.

As described above, the present invention enables expansive expulsive force toward the periphery of the screw barrel and contractive repulsive force to be applied to the wet cake which is being compressed by the screw inside the screw barrel in the axial direction thereof. Since the alternating expansive expulsion and contractive repulsion of the wet cake occur continuously relative to the entire periphery of the screw barrel, the screw press dehydrator provided with the cake cutter according to this invention permits uniform removal of water from the wet cake without entailing any notable pulsation.

What is claimed is:

1. A screw press dehydrator with a cake cutter comprising:

a rotatable screw;

a screw barrel having said rotatable screw therein, said screw barrel having a discharge outlet at one end thereof; and a plurality of stationary and sliding plates alternately disposed around said screw barrel at a position closer to said discharge outlet, wherein said stationary and sliding plates each possess a circular hole through which said screw barrel extends, the circular holes in said sliding plates have a larger radius than the circular holes in the stationary plate, the stationary plates and the sliding plates are disposed to permit the centers of the stationary plates and the sliding plates to deviate from each other so that the circumference of the circular holes in the stationary plates always contact one point of the circular holes in the sliding plates, and said sliding plates are rotatable so that the center of the circular holes in the sliding plates define a circle having a radius whose length corresponds to the deviation between the centers of the circular holes in said sliding plates and said stationary plates.

2. A screw press dehydrator according to claim 1, further comprising:

a plurality of rotary shafts extending through circular cam holes in said sliding plates; and a plurality of circular cams fastened to said rotary shafts where said rotary shafts pass through said circular cam holes, wherein said circular cams are engageable with said sliding plates to impart a rotational motion to said sliding plates, said deviation between the centers of the circular holes in said sliding plates and said stationary plates is equal to the deviation between the centers of the rotary shafts and the circular cams, and said circular cams are adapted to roll within said circular cam holes.

3. A screw press dehydrator according to claim 2, further comprising:

a plurality of connecting shafts extending through said sliding plates, wherein only the sliding plates closest to ends of said screw barrel have circular cam holes to permit said circular cams to roll therein and the sliding plates between said sliding plates closest to the ends of said screw barrel are collectively connected to said sliding plates closest to the ends of said screw barrel with said connecting shafts so that all of said sliding plates rotate simultaneously.

4. A screw press dehydrator according to claim 2, wherein all of the sliding plates possess circular cam holes to permit said circular cams to roll therein and said circular cams are arranged on said rotary shafts so the direction of deviation between the axis of said circular cams and the axis of said rotary shafts are incrementally shifted in the sequential sliding plates in conjunction with the direction of deviation between the centers of the circular holes in said sliding and stationary plates.

5. A screw press dehydrator according to claim 1, further comprising:

means to rotate said sliding plates and said rotatable screw synchronously.

* * * * *